United States Patent [19]

Sato

[11] 4,070,837

[45] Jan. 31, 1978

[54] HOLLOW STEEL COLUMN BASE MEMBER AND WELDING THEREOF

[75] Inventor: Kuniaki Sato, Hiratsuka, Japan

[73] Assignee: Kajima Corporation, Tokyo, Japan

[21] Appl. No.: 613,547

[22] Filed: Sept. 15, 1975

Related U.S. Application Data

[63] Continuation-in-part of Ser. No. 385,166, Aug. 2, 1973, Pat. No. 4,048,776.

[30] Foreign Application Priority Data

Aug. 21, 1972 Japan ..... 47-82799
Aug. 21, 1972 Japan ..... 47-82800

[51] Int. Cl.[2] ..... E02D 27/00

[52] U.S. Cl. ..... 52/297; 228/169; 248/357; 52/301

[58] Field of Search ..... 52/298, 301, 482, 483, 52/357, 295–297; 248/357, 19, 188.1, 188.8, 188.9, ; 228/169

[56] References Cited

U.S. PATENT DOCUMENTS

| | | | |
|---|---|---|---|
| 134,269 | 12/1872 | Gray | 52/301 |
| 198,072 | 12/1877 | Bonzano | 52/298 |
| 950,806 | 3/1910 | Richardson | 52/301 |
| 1,258,409 | 3/1918 | Hill | 248/357 |
| 1,488,128 | 3/1924 | Macdonald | 29/482 |
| 1,887,399 | 11/1932 | Costello | 52/292 |
| 2,179,774 | 11/1939 | Zerbe | 228/169 |
| 2,867,036 | 6/1959 | Hovelmann | 29/482 |

*Primary Examiner*—James L. Ridgill, Jr.

[57] ABSTRACT

A steel column base member for connecting a hollow or box-shaped structural steel column member having square, rectangular or annular section, to a concrete foundation, which base plate member is an integral cast or forged body comprising a bottom plate member to engage the foundation, a box-shaped projection upwardly extending from the bottom plate member and having J-shaped grooves formed along overall outer edges of top surface of projection the width of web of projection being broader than thickness of column member, so as to effect groove welding between the bottom surface of the steel column member and the J-shaped grooved surfaces. A method of connecting an hollow or box-shaped steel column member to a base plate member is characterized by, effecting J-shaped groove welding along between J-shaped groove surfaces of base plate member and the bottom surfaces of steel column member.

6 Claims, 11 Drawing Figures

HOLLOW STEEL COLUMN BASE MEMBER AND WELDING THEREOF

This application is a continuation-in-part application of Ser. No. 385,166 filed Aug. 2, 1973, now U.S. Pat. No. 4,048,776.

BACKGROUND OF THE INVENTION

1. Field of the Invention

This invention relates to a steel column base plate member for connecting a hollow or box-shaped steel column member having square, rectangular or annular section of a steel structure to concrete foundation therefor.

2. Description of the Prior Art

Steel column members of architectural buildings or construction structures are connected to concrete foundations, by means of base plates. It is well known that the steel column is stronger than the concrete of the foundation by a factor of not smaller than 10. To compensate for such difference of the strength between the concrete of the foundation and the steel column, the lower end of the column is joined to a steel plate, and the base plate is secured to the concrete foundation by means of anchor bolts embedded in the concrete foundation.

It has been suggested to provide a base for a column having a recess adapted to accommodate the lower end of the column as shown in U.S. Pat. No. 134,269 issued to J. Gray on Dec. 24, 1872. This base is formed at its center with the recess to reduce its thickness at the center so that the strength against a vertical force may become insufficient to support a load.

It has also been suggested to fit a foot within a lower end of a column which is then inserted into a bed-plate with a sleeve or socket to bring the foot into contact with the bed-plate, disclosed for example as in U.S. Pat. No. 198,072 issued to A. Bonzano on Dec. 11, 1877. This bed-plate will support a vertical force but insufficient to support a bending moment transmitted from the column which will probably been supported by the sleeve.

It has also been suggested to provide a base-socket having a supporting base member and an upwardly projecting portion containing a recess to receive the lower end of a column which is secured within the socket by riveting or the like. Such a socket has been disclosed in the U.S. Pat. No. 1,258,409 issued to T. Hill on Mar. 5, 1918. However, the socket has a configuration prone to give rise to a stress concentration and fails in smooth stress transmission through the socket from the column to a concrete foundation.

It has been proposed to join a tubular member to metal parts wherein the tubular member is fitted within a metal part and a plug or wedge is press fitted in the tubular member. Such a connection has been disclosed in the U.S. Pat. No. 1,488,128 issued to H. P. Macdonald on Mar. 25, 1924. However, this arrangement is not suitable for use in a construction to be subjected to great forces and bending moments.

It has also been proposed to join a tube to a metal part by the use of welding with the aid of beveling portions of the tube. Such a connection of tubing has been disclosed in the U.S. Pat. No. 2,867,036 issued to H. Hovelmann on June 6, 1959. In the method, however, it is required complicated machining for providing the beveling for welding which will increase cost of the connection.

Generally speaking, the base plate member is required to fulfill the following conditions.

1. Since the base plate will be subjected to various severe forces resulting from axial force, shearing force and bending moment acting upon the column member, the base plate must be in configuration to avoid any stress concentration and perform a smooth stress transmission from the column member to the foundation.

2. In order to decrease the cost of a construction as a whole, the working of column member should be minimized only to cutting of both ends thereof. If any grooves for welding are required, the base plate member should be formed with such grooves by the use of means of minimum possible cost.

3. If utilizing any welding method for connecting the base plate member to a column member, the base plate member should be of a configuration capable of applying the most effective welding method which is higher in reliability, minimum of consumed welding rods and carried out with ease. The configuration is also applicable of a best welding method of which characteristic meets stresses derived from forces and bending moments to which the column member is subjected.

4. The base plate member should be a configuration in agreement with a stress distribution acting thereupon resulting from axial and shearing forces and bending moment to which the column member is subjected.

5. The base plate member should be such a configuration that a base portion of the base plate member in contact with a concrete foundation will not be affected by heating derived from welding of the plate member with the column member.

6. The base plate member should be economical of manufacture and serve to decrease the cost of a construction as a whole.

SUMMARY OF THE INVENTION

Accordingly, it is an object of the present invention to provide a steel column base plate member for connecting a hollow steel column member to a concrete foundation which overcomes the above disadvantages in the prior art and fulfills the above requirements for this kind of the base plate.

It is another object of the invention to provide a steel column base plate member, which has a novel configuration to avoid any stress concentration to perform a smooth stress transmission from a column member to a foundation and to make it possible to perform a J-shaped groove welding between a lower end of column and base plate adapted to meet stresses acting upon the base plate.

It is further object of the present invention is to provide a novel base plate member, which is formed by casting or forging in a unitary body with grooves formed on the top surface of projections for effecting the J-shaped groove welding and has a configuration in agreement with a stress distribution acting thereupon and adapted not to be subjected to a detrimental effect of welding heating with the surface in contact with the foundation.

It is still more object of the invention to provide a base plate member for connecting a hollow steel column member to a concrete foundation, which is inexpensive of manufacture and serves to decrease the total cost of a construction.

In one aspect, the invention provides a base plate member for connecting a hollow steel column member to a concrete foundation, which base plate member is a unitary body comprising a steel column base plate member for connecting a hollow steel column member to a concrete foundation, which base plate member is a unitary body comprising a substantially planar bottom plate portion engageable with said concrete foundation, a projection upwardly extending from the planar bottom plate portion and having a top surface whose shape is substantially identical to but somewhat wider inwardly than cross sectional shape of the steel column member, J-shaped welding grooves formed along overall outer edges of said top surface of said projection facing to a lower end of said column member extending from outer peripheries of the top surface of said projection so as to effect J-shaped groove welding between said lower end of the column member and the J-shaped welding grooves, a sloped top surface formed between said projection and said bottom plate portion so as to increase the thickness thereof as the planar bottom plate portion extends toward said projection, and abutments formed on the planar bottom portion in a sufficient thickness and having anchor belt holes bored therethrough.

In another aspect, the invention provides a method of connecting a hollow steel column member to a base plate member, wherein said base plate member comrises a substantially planar bottom plate portion, a projection extending from the planar bottom plate portion and having a top surface whose shape is substantially identical to but somewhat wider inwardly than cross sectional shape of the steel column member, J-shaped welding grooves formed along overall outer edges of said top surface of said projection facing to lower ends of flanges of said column member, the improvement characterized by, the steps of connecting at least one strap to inside of the lower end of said steel column member by welding so as to substantially in opposition to a residual top surface formed with said J-shaped grooves for determining an axial position of said column member relative to the base plate member, placing the lower end surface of said column member onto said top surface of said base plate member in desired relation, and effecting J-shaped groove welding along said J-shaped grooves of said base plate member between bottom surface of said column member and said grooved surfaces of said base plate member.

BRIEF DESCRIPTION OF THE DRAWING

For a better understanding of the invention, reference is made to the accompanying drawing, in which.

DESCRIPTION OF THE PREFERRED EMBODIMENTS

Figure 1:
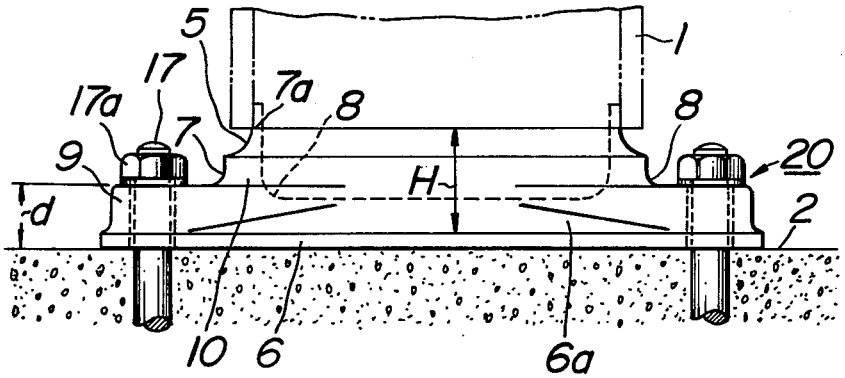
FIG. 1 is an elevation of a steel column base plate member for supporting a hollow column member having a square section, according to the invention.
Figure 2:
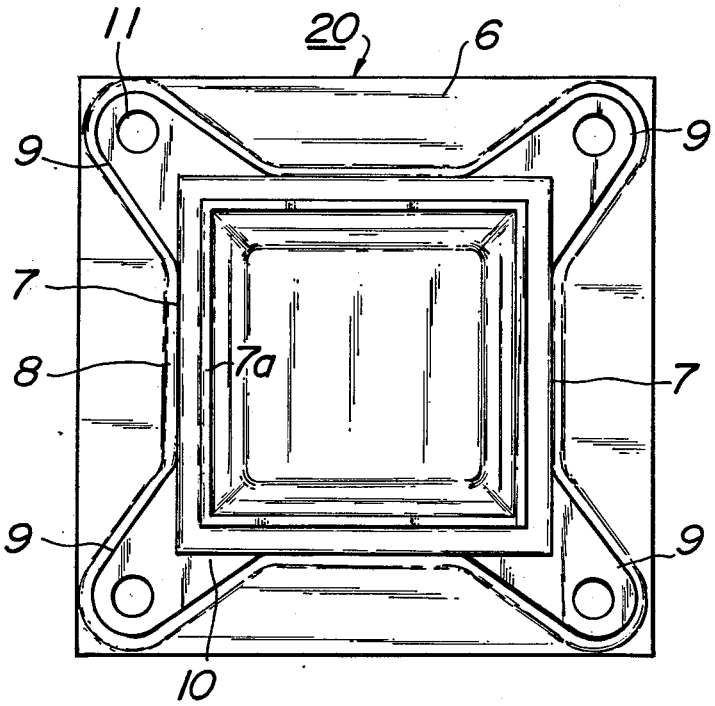
FIG. 2 is a plan view of the base plate member of FIG. 1.

Referring to FIGS. 1 and 2, a steel column base plate member 20 according to the present invention is to join a box-shaped steel column member or hollow steel column member having a square section 1 to a concrete foundation 2. The base plate member 20 itself is secured to the concrete foundation 2 by anchor bolts 17 and nuts 17*a*.

The base plate member 20 has a planar bottom plate portion 6 whose bottom surface area is large enough to distribute the load of the steel column member 1 to the concrete foundation 2 at a stress which is below an allowable limit to the concrete member of the foundation 2 through the interface between the base plate member and the concrete foundation. A projection 7 is integrally formed with the planar bottom portion 6 so as to form a top surface 7*a* whose shape is substantially identical to the cross section of the hollow steel column member 1, said top surface 7*b* of projection having a broader width than that of the steel column member 1, and a J-shaped groove 5 formed along all the edges of top surface 7*a* of projection, the width of which groove 5 is substantially identical to the bottom surface of flange of the steel column member so as to effect groove welding between the grooved surface of projection and the bottom surface of steel column member, and a residual top surface 7*a* of projection extending inwardly from the edge thereof.

Referring to FIG. 1, the height H of the projection 7 is determined on the basis of the ease of welding the column member 1 to the top surface 7*a* and the suppression of the welding strain or bending of the base plate member 20 due to the welding of the column member 1 thereto.

Smoothly curved surface portions 8 are formed where the projection 7 rises from the planar portion 6, so as to eliminate any stress concentration in the base plate member 20 due to the presence of sharp corners. Thus, the radius of curvature of the curved surface 8 must be chosen on the basis of effective suppression of the stress concentration. Whereby, the smooth transfer of the load of the column member 1 toward the concrete foundation 2 is ensured.

The planar portion 6 has a sloped or tapered top surface 6*a*, so that the thickness of the planar portion 6 increases as it extends toward the projection 7. With such sloped top surface 6*a*, the thickness of the planar portion 6 is increased at those parts where the stress is high, while allowing comparatively thin thickness to the less stressed parts thereof. As a result, the rigidity of the projection 7 is enhanced, too. Furthermore, superfluous thickness of the base plate 20 is eliminated.

Abutments 9 are integrally formed at the parts where anchor bolt holes 11 are bored through the base plate member 20. The top surface of the abutment 9 is made parallel to the bottom plane of the planar portion 6, so as to stabilize the contact surface between the nut 17*a* and the abutment 9. It is, of course, possible to insert suitable washers (not shown) between the abutment and the nuts 17*a*. Referring to FIGS. 1 and 2, the width and the thickness *d* of the abutment 9 are so chosen as to ensure smooth transfer of the load of the column member 1 toward the anchor bolts 17. Suitably curved surfaces 10 are formed at the junction between the abutment 9 and the projection 7, for preventing stress concentration thereat.

The steel column base plate member 20 of the aforesaid construction may be made by casting or by forging.

According to the present invention, the top surface of the projection has a width broader inwardly than that of the thickness of the column member.

The J-shaped groove 5 is formed along the edges of top surface 7*a* of projection, the width of which groove 5 is substantially identical to or broader than the thickness of the bottom surface of the steel column member so as to effect groove welding between the J-shaped grooved surface of projection and the bottom surface of the steel column member and the residual top surface 7*a* of projection extending inwardly from the edge of groove so as to determine a vertical position of the column relative to the base plate with the aid of straps later explained. The J-shaped welding grooves 5 are formed at the time of casting or forging of the base plate member 20 per se.

Figure 3:
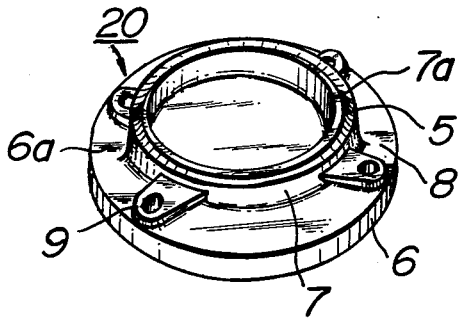
FIG. 3 is a perspective view of a base plate member for a hollow column member having a circular section, according to the invention.

FIG. 3 illustrates a steel column base plate member 20 formed with an annular J-shaped welding groove 5 for welding a steel column member having a circular section.

Though the box-shaped or hollow column member has been shown as the square or circular sectional column member, it may have any other section such as triangular, rectangular, polygonal, elliptical or any other irregular section.

The base plate member may be preferably formed with a center line or center lines (not shown) at the time of casting or forging corresponding to scores marked in the column member by a scraper and lines marked in the concrete foundation for facilitating the correct registering of the base plate member 20 relative to the column member and the concrete foundation.

Figure 4:
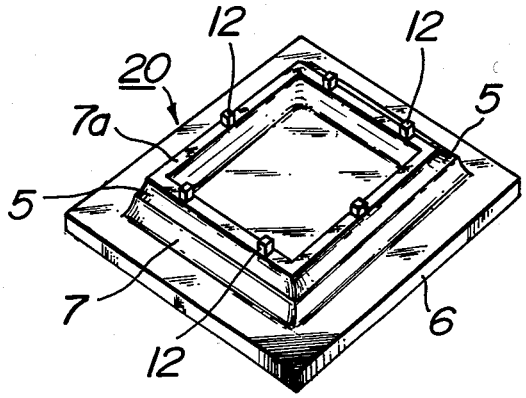
FIG. 4 is a perspective view of a base plate member for a box-shaped column member formed on its top surface with bosses according to the invention.

To facilitate the correct registering of the steel column member 1 relative to the base plate member 20, suitable bosses 12 may be provided at the top surface 7*a* of the projection as shown in FIG. 4.

Figures 5A, 5B, 5C:
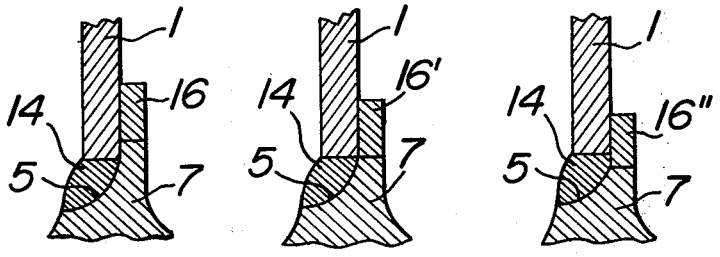
FIGS. 5*a*, 5*b* and 5*c* are sectional views explanatorily showing the butt welding and lower end of the column member.

In actual construction, in order to determine the position of the column member relative to the base plate member in a vertical direction, straps 16 are fixed to the insides of the column member at its lower end by means of welding as shown in FIG. 5. The strap 16 is preferably positioned slightly inside of the lower end of the column member such as a few millimeters, at most 5 millimeters. In this case there is no risk of extruding of J-shaped groove welded bead 14 into the inside of the column member, so that the straps are not necessarily provided on overall inside of the column member. A strap 16' of which end is flush with the lower end of the column member should be provided on overall inside of the column member to prevent the J-shaped groove welded bead 14 from extending into the inside of the column member. In this case, however, the lower end of the column member with the strap 16' is preferably machined after the welding of the strap. A strap 16'' may be provided which slightly extends from the lower end of the column member. If a column member has a circular section, the strap 16 may be annular or annular segmental along the inside of the column member.

In the actual construction, J-shaped groove welding or butt welding is performed along the top surface 7*a* to form welding beads 14 as shown in FIG. 5. It is apparent to those skilled in the art that the use of bosses 12, as shown in FIG. 4, will facilitate the registration or indexing of the column member 1 with the base plate member 20.

In using the base plate member 20 according to the invention for a construction, the straps 16 or 16' are welded to the insides of the column member at its lower end and the top surface 7*a* is brought into contact with the lower end of the straps of the column member with the aid of the center lines of the plate member in registry with the scores of the column member. Tack welding is effected at several locations between the lower end of the column member and the grooves of the base plate member for fixing a relative position therebetween to facilitate the subsequent butt welding. Then J-shaped groove welding or butt welding is effected to form beads 14 between the lower end of the column member and the protrusion 7.

The column member and the base plate member thus united are brought onto a concrete foundation such that anchor bolts 17 extending from the foundation pass through the anchor bolt holes 11 and the center lines of the base plate member are in registry with the lines marked in the concrete foundation. The nuts 17*a* are threadedly engaged with the anchor bolts 17 and then tightened with a determined amount of torque as by means of a suitable equipment such as a constant torque wrench.

The base plate member for the H-shaped column member according to the present invention has following characteristics distinguishable over those in the prior art.

1. Outer configuration

The base plate member according to the present invention has the configuration as shown in FIGS. 1, 2, 3 and 4. There are smoothly curved surface portions 8 at the junctions between the projection 7 and the sloped top surface 6*a* and further smoothly curved surface portions at the junctions 10 between the abutments 9 and the planar bottom portion 6. These smooth surfaces prevent any stress concentration and serve to transmit smoothly the load from the column member to the concrete foundation.

The flaps 16 welded to the column member are in contact with the top surface of the base plate member to provide a metal contact which serves to keep an accuracy of the height of the column member and makes it easy to set the column member on the concrete foundation.

The J-shaped grooves for butt welding are integrally formed in the base plate in casting or forging so that the forming of the J-shaped grooves scarcely increases the cost of the base plate and the column member is not required to have any worked portion for butt welding. Accordingly, the working of column members will be simplified to save time and cost for manufacturing the construction.

2. Application of butt weldings

It has been known that shearing strengths of fillet and butt welded portions at their throats are substantially equal to each other, while the tensile strength of the butt welded portion is generally higher than that of the fillet welded portion.

Figure 6:
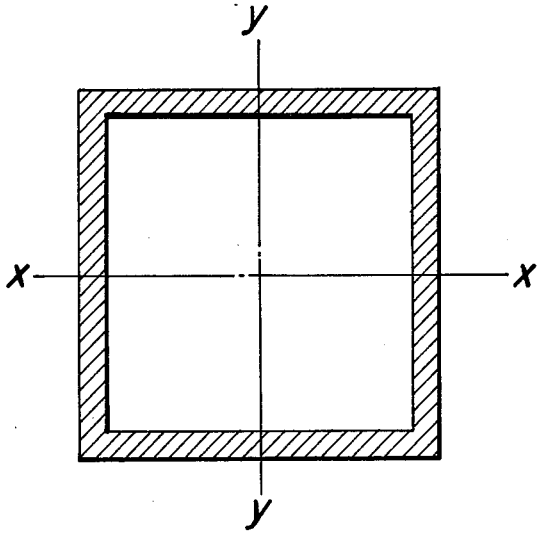
FIG. 6 is a sectional view of a typical box-shaped column member for explaining the directions of the column member subjected to bending moments.

Box-shaped or hollow section steel column members are used in the case that bending moments act on the column members in both $x$ and $y$ directions (FIG. 6). Accordingly, all four walls of a rectangular hollow column member are subjected to compressive and tensile forces due to the bending moments, so that the four walls of the column member are connected to the base plate member by butt welding or J-shaped welding which is more effective to resist to a tensile force. Therefore, the base plate member for the hollow column member according to the invention utilizes the characteristics in strength of the butt welding to enable the base plate to support a load in the most effective manner.

Figure 7A:
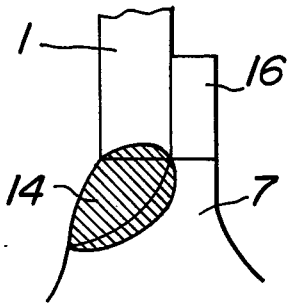
FIGS. 7*a* and 7*b* are schematic sectional views of J-shaped groove weld and L-shaped groove weld, respectively.
Figure 7B:
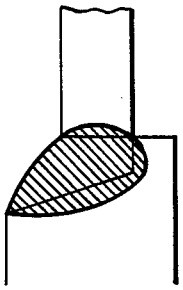

An amount of weld metal or deposited metal in the J-shaped welding is less than those in any other welding methods for the same purpose. The reliability in penetration or weld penetration in the proximity of the root of J-shaped groove weld is higher than those in any other methods and also higher than that in L-shaped groove weld as shown in FIG. 7. The J-shaped groove welding operation can be carried out with ease. In spite of these advantages, the J-shaped groove welding requires to form J-shaped grooves which are apt to increase the cost of welding. According to the invention by casting and forging the base plate member, J-shaped grooves can easily be formed in the base plate member, so that the base plate member can utilize the advantages of the J-shaped groove welding without increasing cost for providing the J-shaped grooves.

3. Dynamics on the base plate

Figure 8:
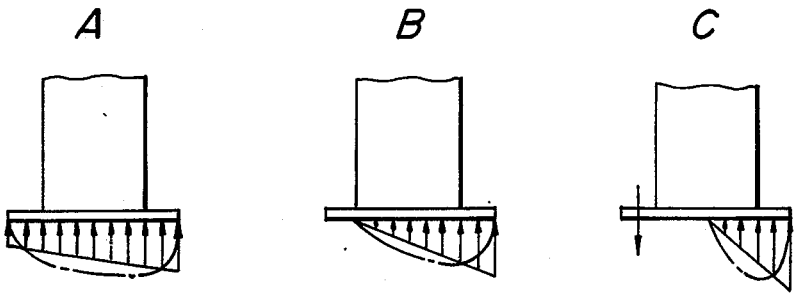
FIG. 8 illustrates various reaction distributions depending upon the relation between bending moments and compressive forces.

The column member is subjected to the axial force N, the bending moment M and the shearing force Q which act between the base plate and the concrete foundation. Depending upon the magnitude of these forces and their combination, a reaction force between the base plate and the foundation varies in distibution and amount as shown in FIG. 8. FIG. 8A shows the reaction force in case of the bending moment is relatively small in comparison with the compressive force, FIG. 8B is in case of the bending moment is normal or intermediate and FIG. 8C is in case of the moment is a great value. In any case, these compressive force, bending moment and shearing force simultaneously act upon the column member, so that reaction forces are caused between the base plate member and the column member as shown in arrows in FIG. 8 wherein solid lines of the arrows show theoretical distribution of the reactions and dot-and-dash lines show actual distributions. In case of FIG. 8C, due to the great moment, one flange of the column member tends to raise to cause a great tensile force in anchor bolts.

When the base plate member is subjected to a great contact force in an axial direction of the column member which causes a bending action (a positive bending moment) on the plate member, so that the plate member is required to have sufficient yield strength and rigidity to resist to the bending action.

When the anchor bolts are subjected to a great tensile force as shown in FIG. 8C, a great reaction force is caused in the proximity of the holes for the bolts formed in the base plate and results in a bending action (a negative bending moment) on the plate member, so that the member is required to have sufficient yield strength and rigidity to resist to the action.

The bending moment and the shearing force generally act on the base plate member as alternate stresses. Accordingly, the base plate member is generally required to have a symmetrical yield strength and rigidity. The yield strength will resist to the stress so as not to be broken and the rigidity will resist to the stress so as to restrain a deformation.

At any rate, when the base plate member is subjected to reaction forces as shown in FIGS. 8A, 8B and 8C, the base plate will be subjected to a bending action of which bending stress is maximum at the place on the base plate member in opposition to the flanges and web of the column member.

Accordingly, the feature of the projection 7 of the base plate projecting from the base portion and corresponding to the sectional area of the column member and the feature of decreasing the thickness of the bottom plate portion toward the outer ends thereof provided a rational configuration in agreement with the stress distribution. In addition, with the configuration the top surface of the projection to be welded to the lower end of the column member is remote from the base portion of the base plate member so as to be remote from the portions subjected to violent heating for welding, thereby preventing the base portion from deforming in welding. The base plate member having a changing thickness can be advantageously made by casting or forging.

4. Cost comparison

We compared the cost of the cast steel base plate members according to the invention with that of the prior art steel base plates for box-shaped column members having one side of 550 mm. One example of the comparison is indicated in Table I.

Table I

| | | | Cast steel base plate (Present invention) | | Steel base plate (Prior art) | |
|---|---|---|---|---|---|---|
| | | Unit price | Total weight | Total cost | Total weight | Total cost |
| Material cost | Casting | \$0.605/lb (Y400/kg) | 640 lbs (290 kgs) | \$387 (Y116,000) | 0 | 0 |
| | Steel plate | \$0.151/lb (Y100/kg) | 0 | 0 | 1,072 lbs (486 kgs) | \$162 (Y48,600) |
| | Welding rod | \$0.423/lb (Y280/kg) | 0 | 0 | 110 lbs (50 kgs) | \$46.7 (Y14,00) |
| | | Total | 640 lbs. (290 kgs) | \$387 (Y116,000) | 1,182 lbs (536 kgs) | \$208.7 (Y62,600) |
| Working cost | Labor cost | \$33.3/man (Y10,000/man) | | | | |
| | Indirect cost | \$16.7/man (Y5,000/man) | 0 | 0 | 4.96 man | \$248 (74,400) |
| Total | | | \$387 (Y116,000) | | \$456.7 (Y137,000) | |
| Economical Comparison | | | 85% | | 100% | |

A number of cast steel base plates of totally 640 lbs according to the invention were used in the comparison, which only require casting operation but not require any other operation such as working or welding operation for providing the base plates themselves. Accordingly, the total cost was $387. In contrast herewith the steel base plates of the prior art require the steel plates of 1,072 lbs and welding rods of 110 lbs for providing the number of the base plates equal to the above cast steel plates and further require the working operation with direct and indirect costs, so that the total cost was $456.7. The cost of the cast steel base plate according to the invention is only 85% of that of the welded steel base plate of the prior art.

As can be seen from the above description, the base plate member according to the invention has a various of novel features of the configuration making it possible to effect a J-shaped groove welding or butt welding to meet the stress condition acting upon the column member and the base plate; preventing the base portion from deforming in welding by arranging the welding portion on the top of the protrusion remote from the base portion; having an effective sectional shape to meet the bending stress distribution; and making it possible to effect the effective J-shaped groove welding.

It is understood by those skilled in the art that the foregoing description is a preferred embodiment of the disclosed base plate and that various changes and modifications may be made in the invention without departing from the spirit and scope thereof.

What is claimed is:

1. A steel column base plate member for connecting a hollow steel column member to a concrete foundation, which base plate member is a unitary body comprising a substantially planar bottom plate portion engageable with said concrete foundation, a projection upwardly extending from the planar bottom plate portion and having a top surface whose shape is substantially identical to but somewhat wider inwardly than cross sectional shape of the steel column member, J-shaped welding grooves formed along overall outer edges of said top surface of said projection facing to a lower end of said column member extending from outer peripheries of the top surface of said projection so as to effect J-shaped groove welding between said lower end of the column member and the J-shaped welding grooves, a sloped top surface formed between said projection and said bottom plate portion so as to increase the thickness thereof as the planar bottom plate portion extends toward said projection, and abutments formed on the planar bottom portion in a sufficient thickness and having anchor bolt holes bored therethrough.

2. A steel column base plate member according to claim 1, wherein the J-shaped groove is formed along the edges of top surface of projection so as to effect groove welding between the J-shaped grooved surface of projection and the bottom surface of the steel column member and the residual top surface of projection extending inwardly from the edge of groove for determining a vertical position of said column member relative to said base plate member.

3. A steel column base plate member according to claim 1, said member further comprising smoothly curved surface portions at junctions between said projection and said sloped top surface and smoothly curved surface portions at the junctions between said abutments and said planar bottom portions.

4. A steel column base plate member according to claim 1, wherein said top surface has indexing bosses which are integrally formed therewith.

5. A steel column base plate member according to claim 1, wherein said hollow steel column member has a quadrilateral section.

6. A steel column base plate mamber according to claim 1, wherein said hollow steel column member has an annular section.

* * * * *